US005874801A

United States Patent [19]

Kobayashi et al.

[11] Patent Number: 5,874,801

[45] Date of Patent: Feb. 23, 1999

[54] ANTI-REFLECTION MEMBER, MANUFACTURING METHOD THEREOF, AND CATHODE-RAY TUBE

[75] Inventors: Tomio Kobayashi; Hideaki Hanaoka, both of Kanagawa, Japan

[73] Assignee: Sony Corporation, Tokyo, Japan

[21] Appl. No.: 713,013

[22] Filed: Sep. 12, 1996

[30] Foreign Application Priority Data

Sep. 14, 1995 [JP] Japan ..... 7-262460

[51] Int. Cl.[6] ..... H01J 31/00

[52] U.S. Cl. ..... 313/478; 313/477 R; 313/479

[58] Field of Search ..... 313/477 R, 478, 313/466, 479–80, 110, 112–13, 634, 489, 492

[56] References Cited

U.S. PATENT DOCUMENTS

| | | | |
|---|---|---|---|
| 4,075,632 | 2/1978 | Baldwin et al. | 343/6.8 |
| 4,598,275 | 7/1986 | Ross et al. | 340/573 |
| 4,733,633 | 3/1988 | Yarnall, Sr. et al. | 119/29 |
| 4,804,883 | 2/1989 | Muller et al. . | |
| 5,218,344 | 6/1993 | Ricketts | 340/573 |

FOREIGN PATENT DOCUMENTS

| | | |
|---|---|---|
| 0 025 816 | 4/1981 | European Pat. Off. . |
| 0 200 452 | 11/1986 | European Pat. Off. . |
| 0 624 313 A1 | 11/1994 | European Pat. Off. . |
| 0 636 312 A1 | 2/1995 | European Pat. Off. . |
| 3717109 | 12/1987 | United Kingdom . |
| WO 84/00869 | 3/1984 | WIPO . |
| WO 93/14474 | 7/1993 | WIPO . |
| WO 94/02004 | 3/1994 | WIPO . |
| WO 96/19915 | 7/1996 | WIPO . |

*Primary Examiner*—Ashok Patel
*Assistant Examiner*—Mack Haynes
*Attorney, Agent, or Firm*—Hill & Simpson

[57] ABSTRACT

A anti-reflection member provided with an antistatic function and an electromagnetic radiation shielding function and having a reflection preventing optical thin film excellent in adhesion with the hard coat layer.

The anti-reflection member comprises a laminate composed of substrate, hard coat layer, and reflection preventing optical thin film having at least two layers, the first layer of the reflection preventing optical thin film provided in contact with the hard coat layer comprises a transparent conductive oxide film (for example, $SnO_2$, ZnO, $In_2O_3$, or ITO) formed by reactive physical vapor phase deposition, and the second layer of the reflection preventing optical thin film consists of a material (for example, $SiO_2$ or $MgF_2$) having a refractive index smaller than that of the first layer.

11 Claims, 3 Drawing Sheets

ANTI-REFLECTION MEMBER, MANUFACTURING METHOD THEREOF, AND CATHODE-RAY TUBE

BACKGROUND OF THE INVENTION

1. Field of the Invention

This invention relates to an anti-reflection member and manufacturing method thereof, and relates to a cathode ray tube having a front panel applied with such anti-reflection member.

2. Description of Related Art

For example for conventional cathode ray tubes (CRT), a picture displayed on the cathode ray tube is not viewed clearly because external light is reflected on the panel surfacel; that is a problem of conventional cathode ray tubes. On the other hand, the potential of the panel surface changes because of high voltage applied on the fluorescent screen formed on the inside surface of the panel of the cathode ray tube. As a result, dust adheres on the panel surface and the panel causes an electric discharge to an approching human body. To prevent such phenomena, it is required to provide an antistatic function on the panel surface. In addition, it is also important to provide an electromagnetic radiation shielding function so as not to release electromagnetic waves from the cathode ray tube. As a method for solving all the technical problems as described herein above, a technique in which an anti-reflection member having conductivity is applied on the panel surface has been known.

Such an anti-reflection member comprises a laminate composed of a substrate, a hard coat layer, and a multilayered reflection preventing optical thin film. The substrate consists of, for example, polyethyl-eneterephthalate (PET) or polycarbonate (PC). A hard coat layer consists of, for example, polymethyl-methacrylate (PMMA), and is formed on the surface of the substrate because the surface is susceptible to touching. In the case that it is not necessary to provide an antistatic function and an electromagnetic radiation shielding function to an anti-reflection member, at least two layers of dielectric thin film consisting of SiO, $SiO_2$, $TiO_2$, $ZrO_2$, $Ta_2O_5$, and $Y_2O_5$, for example, and a high refractive index film/low refractive index film/high refractive index/low refractive index film . . . ) are formed on the hard coat layer. Materials having high refractive index (having a refractive index of 1.8 to 2.7 at around the wave length of 550 nm) such as $TiO_2$, $ZrO_2$, $Ta_2O_5$, and $Y_2O_5$ are excellent in adhesion with hard coat layers consisting of polymethyl-methacrylate.

On the other hand, in the case that it is necessary to provide an antistatic function and an electromagnetic radiation shielding function to an anti-reflection member, it is preferable to structure a reflection preventing optical thin film by laminating a transparent conductive oxide film and a thin film (referred as to low refractive index film hereinafter) consisting of a material having lower refractive index than that of the material used for the transparent conductive oxide film. By structuring the reflection preventing optical thin film as described herein, not only is antistatic function and electromagnetic radiation shielding function due to transparent conductive oxide film provided to the anti-reflection member but also an anti-reflection function due to the high refractive index film/low refractive index film structure is provided simultaneously. Thereby the structure of a reflection preventing optical thin film is simplified. An example of the transparent conductive oxide film includes ITO ($I_2O_3$ doped with Sn) film (refractive index is 1.9 to 2.0). On the other hand, examples of the low refractive index film include $SiO_2$ film (refractive index=1.46 at 550 nm) and $MgF_2$ film (refractive index =1.38 at 550 nm).

Usually, by repeating the film forming process, namely, ITO film/low refractive index film/ITO film/low refractive index film . . . on a hard coat layer formed on a substrate, an anti-reflection member is provided with an anexcellent anti-reflection function in the wide wave length range from 450 to 650 nm. A schematic partial cross-sectional view of the anti-reflection member having such structure is shown in FIG. 4A. In FIG. 4A, a reflection preventing optical thin film having a four layer structure is shown; the first layer and third layer consist of ITO film, and the second and fourth layer consist of low refractive index film. Usually, ITO film is formed by spattering using a target of oxide ITO. An ITO film is formed under the spattering condition that the composition of such ITO target is, for example, $In_2O_3/SnO_2$=90 parts by weight/10 parts by weight, target current density is 2 $W/cm^2$, and others are $Ar/O_2$=50 volume %/50 volume %, and 0.2 Pa.

It is reported that the crystallization temperature of ITO ranges from 150° to 200° C. Therefore, to improve the adhesion (adhesion strength) to a hard coat layer, it is desirable to heat the substrate to a temperature of 120° C. or higher. However, such heating of a substrate can cause thermal damage such as deformation of the substrate consisting of plastic material. Heating of a hard coat layer consisting of polymethyl-methacrylate to a temperature of 100° C. or higher can cause the reduction of the hardness.

Recently, ITO film formed on a color filter was used as a transparent electrode for a flat panel display of liquid crystal display devices. Such an ITO film is formed by DC magnetron spattering using ITO target. ITO film formed by such method is excellent in resistivity, wet etching performance, and reproducibility of characteristics. However, an ITO film formed on a hard coat layer by DC magnetron spattering using an ITO target is insufficient in adhesion strength to the hard coat layer.

The inventors of the present invention proposed a new anti-reflection member comprising a laminate of a substrate, a hard coat layer, and a multilayered reflection preventing optical thin film in Japanese Patent Application Hei 7-170925 (application date: Jul. 6, 1995). A schematic partial cross-sectional view of the anti-reflection member having such structure is shown in FIG. 4B. The substrate of the anti-reflection member consists of, for example, polyethylene-terephthalate (PET) and polycarbonate (PC). A hard coat layer consists of, for example, polymethyl-methacrylate (PMMA) an is formed thereon. To provide an antistatic function and an electromagnetic radiation shielding function to the anti-reflection member, the anti-reflection member has the first layer of the reflection preventing optical thin film comprising a conductive light absorbing film, and the second layer of the reflection preventing optical thin film consisting of a material having lower refractive index than that of the material used to structure the first layer.

The conductive light absorbing film consists of a material selected from the group composed of Ag, Au, $TiN_X$ (X=0.3 to 1), $TiO_XN_Y$ (wherein X=0.3 to 1, Y<1, and $Y \leqq X$), $TaN_X$ (wherein X=0.2 to 1), Pt, Al, Cu, Ta, Ni-Cr, Cu-Al, Cu-Zn-Al, Cu-Ni-Al and Cu-Sn-Al, and the thickness ranges from 4 to 40 nm. On the other hand, the second layer of the reflection preventing optical thin film consists of $SiO_2$ or $MgF_2$. The above-mentioned material to be used for the conductive light absorbing film has a characteristic that light absorption coefficient changes dependently on wave length.

Reflection is prevented for a wide range of wave length (430 to 650 nm). This is possible even if the reflection preventing optical thin film has a two layer structure. The light transmittance of these materials ranges from 70 to 90%, however, because the two layer structure can be used for the reflection preventing optical thin film, the low light transmittance of the conductive light absorbing film does not cause any problem.

However, it was found that the adhesion (adhesion strength) of such conductive light absorbing film to a hard coat consisting of polymethyl-methacrylate was insufficient.

Therefore, it is the object of the present invention to provide an anti-reflection member provided with an anti-static function and an electromagnetic radiation shielding function which has a reflection preventing optical thin film excellent in adhesion to a hard coat layer, and a manufacturing method thereof. In addition, a cathode ray tube having a front panel applied with such anti-reflection member is provided.

SUMMARY OF THE INVENTION

A anti-reflection member in accordance with the first embodiment of the present invention for achieving the above mentioned object is the anti-reflection member comprising a laminate of substrate, hard coat layer, and reflection preventing optical thin film having at least two layers, wherein the first layer of the reflection preventing optical thin film in contact with the hard coat layer consists of transparent conductive oxide film formed by reactive physical vapor phase deposition, and the second layer of the reflection preventing optical thin film consists of a material having a lower refractive index than that of the first layer.

A manufacturing method of an anti-reflection member in accordance with the first embodiment of the present invention for achieving the above-mentioned object is the manufacturing method of an anti-reflection member comprising a laminate of substrate, hard coat layer, and reflection preventing optical thin film having at least two layers, wherein the first layer of the reflection preventing optical thin film in contact with the hard coat layer consists of transparent conductive oxide film, and the second layer of the reflection preventing optical thin film consists of a material having a lower refractive index than that of the first layer, and the transparent conductive oxide film is formed by reactive physical vapor phase deposition.

Wherein, the "transparent" of the transparent conductive oxide film means the absorption coefficient $\alpha$ based on Lambert's law of 0 to 0.3, preferably, 0 to 0.2 when a light with a wave length of 550 nm is transmitted. The "conductive" of the transparent conductive oxide film means the value of resistance measured by eddy current method of $1\times10$ to $1\times10^4$ $\Omega/\square$, preferably, $1\times10$ to $5\times10^3$ $\Omega/\square$.

In the anti-reflection member, or the manufacturing method thereof, in the first embodiment of the present invention, examples of the reactive physical vapor phase deposition, namely, physical vapor phase deposition (PVD, Physical Vapor Deposition) accompanying chemical reaction between at least partial material to be deposited on the hard coat layer and the material used for the hard coat layer, include;

(A) various vacuum deposition such as electron beam heating, resistance heating, and flush deposition, (B) plasma deposition, (C) various spattering such as bipolar spattering, DC spattering, DC magnetron spattering, high frequency spattering, magnetron spattering, ion-beam spattering, and bias-spattering, and (D) various ion-plating such as DC method, RF method, multi-cathode method, activation reaction method, HCD method, electric field deposition, high frequency ion-plating, and reactive ion-plating, wherein among these methods, reactive spattering using a metal or alloy target, in detail, DC magnetron spattering is preferably used. In this case, a target material consisting of Sn, Zn, In, or In-Sn alloy is preferably used. When Sn is used as a target, a transparent conductive oxide film obtained by reactive physical vapor phase deposition consists of $SnO_2$. When Zn is used as a target, a transparent conductive oxide film obtained by reactive physical vapor phase deposition consists of ZnO. When In is used as a target, a transparent conductive oxide film obtained by reactive physical vapor phase deposition consists of $In_2O_3$. Further, when In-Sn is used as a target, a transparent conductive oxide film obtained by reactive physical deposition consists of ITO. Spattering is carried out in an $O_2$ atmosphere for the reactive spattering. On the other hand, spattering is carried out in an $Ar+O_2$ (content of $O_2$ is 0 to 30 volume %) atmosphere for conventional spattering using an oxide target.

To improve the adhesion to a hard coat layer, it is preferable that an element (referred to as element B) having the same or higher affinity with oxygen as an element (referred to as element A hereinafter) which constitutes the transparent conductive oxide film is contained in the transparent conductive oxide film. In general, the affinity of an element to oxygen can be estimated from the standard free energy of formation of the oxide. In other words, an oxide having smaller standard free energy of formation forms oxide easier. Though it depends on the element A, an example of the element B includes an element selected from the group composed of Ti, Zr, Al, Mg, Si, Cr, W, Fe, and Mn. Examples of combination of the element A and element B are listed in Table 1. The ratio element B/(element A+element B) (in atomic ratio) is 0.001 to 0.1, preferably 0.005 to 0.05.

TABLE 1

| Element A | Element B |
|---|---|
| Sn | Cr, Ti, Al, Zr |
| Zn | Cr, Ti, Al, Zr |
| In | Cr, Ti, Al, Zr |
| In and Sn | Cr, Ti, Al, Zr |

In the manufacturing method of the anti-reflection member in accordance with the first embodiment of the present invention, a material consisting of the second layer of the reflection prevention optical thin film may be a material having a refractive index of about 1.7 or smaller, examples include $SiO_2$, SiO, $MgF_2$, $CaF_2$, $LaF_3$, $Na_3AlF_6$, $Na_5Al_3Fl_4$, $NdF_3$, $LaF_3$, $CeF_3$, $BaF_2$, NaF, $SrF_2$, and Al2 $O_3$, among these materials, $SiO_2$ or $MgF_2$ is preferably used.

It is preferable that the hard coat layer consists of a material which contains oxygen as a constituent element. In detail, the hard coat layer may be an organic film consisting of a resin-based material selected from the group composed of silicon-based material, polyfunctional acrylate-based material or urethane resin-based material, melamine resin-based material, and epoxy resin-based material, and may be an organic-inorganic film. Examples of silicon-based material include co-hydrolysates of tetra-alcoxysilane or alkyltrialcoxysilane and silane coupling agent having functional group such as epoxy group or methacryl group. Examples of polyfunctional acrylate-based material include, for example, polyol-acrylate, polyester-acrylate, urethane-acrylate, and epoxyacrylate. Furthermore, an example of urethane resin-based material includes, for example, melamine-polyurethane. The hard coat layer consists preferably of acryl-based material, specifically, polymethyl-methacrylate (PMMA). An example of an organic-inorganic film includes acryl-silicon. Otherwise, the hard coat layer of organic-inorganic film may be formed from colloidal silica in a form of hydrophylic sol or lipophilic sol. The hard coat layer may be formed by various methods for coating a material such as dipping coating, spin coating, spray coating, and flow coating followed by drying and thermosetting or ultraviolet ray curing.

In the manufacturing method of the light reflection prevention member in accordance with the first embodiment of the present invention, the anti-reflection member may be manufactured continuously by a process in which the substrate comprises a roll film, the film on which a hard coat layer had been formed previously is unwound, the first layer comprising a transparent conductive oxide film formed on the hard coat layer by reactive spattering using a metal or alloy target therefor. Subsequently, the second layer of an reflection preventing optical thin film is formed on the first layer by spattering, then the film comprising the reflection preventing optical thin film formed on the hard coat layer is wound.

In the manufacturing process of the anti-reflection member in accordance with the first embodiment of the present invention, a $SnO_2$ layer, ZnO layer, $I_2O_3$ layer, or ITO layer is formed on the second layer of the reflection preventing optical thin film, thereon a $SiO_2$ layer or $MgF_2$ layer is formed, further, these two layers may be laminated one above another alternately. In detail, for example, the reflection preventing optical thin film may have a structure such as ITO layer/$SiO_2$ layer/ITO layer/$SiO_2$ layer/ . . . /ITO layer/$SiO_2$ layer, $SnO_2$ layer/$SiO_2$ layer/$SnO_2$ layer/$SiO_2$ layer/ . . . /$SnO_2$ layer/$SiO_2$ layer, or ZnO layer/$SiO_2$ layer/ZnO layer/$SiO_2$ layer/ . . . /ZnO layer/$SiO_2$ layer. Otherwise, the structure may comprise m-th layers (m is odd numbers) consisting of the same or different materials selected from the group composed of $SnO_2$, ZnO, $I_2O_3$, and ITO, and n-th layers (n is even numbers) consisting of the same or different materials selected from the group composed of $SiO_2$ and $MgF_2$ (for example, $SnO_2$ layer/$SiO_2$ layer/ITO layer/$SiO_2$ layer). In this case, a $SnO_2$, ZnO layer, $I_2O_3$ layer, or ITO layer of (2N—l)th layer (wherein 1<N) may be formed by, for example, either reactive spattering or conventional spattering using an oxide target.

The anti-reflection member in accordance with the second embodiment of the invention for achieving the above-mentioned object comprises a laminate of substrate, hard coat layer, and reflection preventing optical thin film having at least three layers, wherein the first layer of the reflection preventing optical thin film in contact with the hard coat layer consists of transparent oxide film formed by reactive physical vapor phase deposition, and the second layer of the reflection preventing optical thin film consisting of conductive light absorbing film, and the third layer of the reflection preventing optical thin film consists of a material having a lower refractive index than that of the second layer.

The manufacturing method of the anti-reflection member in accordance with the second embodiment of the present invention for achieving the above-mentioned object is the manufacturing method of an anti-reflection member comprising a laminate of a substrate, hard coat layer, and reflection preventing optical thin film having at least three layers, wherein the first layer of the reflection preventing optical thin film in contact with said hard coat layer consists of transparent oxide film, and the second layer of the reflection preventing optical thin film consisting of conductive light absorbing film, and the third layer of the reflection preventing optical thin film consists of a material having a lower refractive index than that of the second layer, and the transparent oxide film is formed by reactive physical vapor phase deposition.

Wherein, the "transparent" of the transparent conductive oxide film means the absorption coefficient $\alpha$ based on Lambert's law of 0 to 0.3, preferably, 0 to 0.2 when a light with a wave length of 550 nm is transmitted. The "conductive" of the transparent conductive oxide film means the value of resistance measured by eddy current method of $1\times10$ to $1\times10^4$ $\Omega/\square$, preferably, $1\times10$ to $5\times10^3$ $\Omega/\square$. Further, the "light absorptive" of the conductive light absorbing film means the absorption coefficient of 0 to 0.5 when a light of 550 nm is transmitted, preferably 0.1 to 0.3.

In the anti-reflection member or the manufacturing method thereof in accordance with the second embodiment of the present invention, the same reactive physical vapor phase deposition as described in the anti-reflection member or the manufacturing method thereof in accordance with the first embodiment of the present invention may be used, among these methods, reactive spattering using a metal or alloy target, in detail, DC magnetron spattering is preferably used.

The thickness of the transparent oxide film may be arbitrary as far as the thickness does not influence adversely on the anti-reflection effect. But generally, the thickness is 1 to 20 nm in average provided on a hard coat layer. The transparent oxide film is formed only to improve the adhesion between the second layer of the reflection preventing optical thin film and the hard coat layer.

In the anti-reflection member or the manufacturing method thereof in accordance with the second embodiment of the present invention, the transparent oxide film consists preferably of at least one material selected from the group composed of $ZrO_2$, $TiO_2$, $SiO_X$ (wherein X=1 to 2), $SiO_XN_Y$ (wherein $X=_1$ to 2, Y=0.2 to 0.6), and $CrO_X$ (wherein X=0.2 to 1.5). When reactive spattering is used as the reactive physical vapor phase deposition, a target consisting of Zr is used for forming $ZrO_2$ film, a target consisting of Ti is used for forming $TiO_2$ film, a target consisting of Si is used for forming $SiO_X$ (wherein X=1 to 2) film or $SiO_XN_Y$ (wherein X=1 to 2, and Y=0.2 to 0.6), and a target consisting of Cr is used for forming $CrO_X$ film. The transparent oxide film may be provided with conductivity. For providing conductivity, the transparent oxide film may consist of $SnO_2$, ZnO, $In_2O_3$, or ITO, and the film formed by reactive physical vapor deposition in the same manner as described in the description of the anti-reflection member or the manufacturing method thereof in accordance with the first embodiment of the present invention.

To improve the adhesion to a hard coat layer, it is preferable that an element (referred to as element D hereinafter) having the same or higher affinity with oxygen as an element (referred to as element C hereinafter) which constitutes the transparent oxide film is contained in the transparent oxide film. Though it depends on the element C, examples of the element D includes an element selected from the group composed of Ti, Zr, Al, Mg, Be, Si, Cr, W, Fe, Mn, and Sn. Examples of the combination of the element C and element D are listed in Table 2. The ratio element D/(element C+element D) (in atomic ratio) is 0.001 to 0.1, preferably 0.005 to 0.05.

TABLE 2

| Element C | Element D |
|---|---|
| Zr | Mg, Be |
| Ti | Al, Zr, Be |
| Si | Ti, Al, Zr, Be |
| Cr | Si, Ti, Al, Zr, Be |

In the anti-reflection member or the manufacturing method thereof in accordance with the second embodiment of the present invention, the conductive light absorbing film consists preferably of metal, alloy, metal nitride or metal oxide-nitride. Wherein, nitrides of alloy and nitride-oxides of alloy are included in the term "metal nitride" and "metal oxide-nitride". In detail, examples of material to be used for the conductive light absorbing film include materials selected from the group composed of Ag, Au, TiNX (X=0.3 to 1), $TiO_XN_Y$ (wherein X=0.3 to 1, Y<1, and Y≦X), $TaN_X$ (wherein X=0.2 to 1), Pt, Al, Cu, Ta, Ni-Cr, Cu-Al, Cu-Zn-Al, Cu-Ni-Al and Cu-Sn-Al. Oxygen and Nitrogen happen to be trapped occasionally during forming of the conductive light absorbing film consisting of metal or alloy, however herein, this conductive light absorbing film is defined as the conductive light absorbing film consisting of metal or alloy.

In the anti-reflection member or the manufacturing method thereof in accordance with the second embodiment of the present invention, examples to be used for the third layer of the reflection preventing optical thin film include $SiO_2$, $MgF_2$, $CaF_2$, $LaF_3$, $Na_3AlF_6$, $NdF_3$, $LaF_3$, and $Al_2O_3$, among these materials, $SiO_2$ or $MgF_2$ is preferably used. The hard coat layer may consist of the same material as described in the description of the reflection preventing member or the manufacturing method thereof in accordance with the first embodiment of the present invention, among these materials, in detail, the hard coat layer consists preferably of polymethyl-methacrylate (PMMA).

In the manufacturing method of the light reflection prevention member in accordance with the second embodiment of the present invention, the anti-reflection member may be manufactured continuously by a process in which a substrate comprises a roll film, the film on which a hard coat layer had been formed previously is unwound, the first layer comprising the transparent oxide film is formed on the hard coat layer by reactive spattering using a metal or alloy target, subsequently the second layer of reflection preventing optical thin film comprising the conductive light absorbing film is formed on the first layer by spattering, then the third layer of the reflection preventing optical thin film is formed on the second layer by spattering, finally the film comprising the reflection preventing optical thin film formed on the hard coat layer is wound.

In the present invention, the substrate may consist of any material as far as the material transmits light. A material to be used for the substrate may be selected dependently on required specification and application field of the anti-reflection member, and may be selected from plastic materials or glass materials. When plastic material is selected to form the substrate, examples include, polyethyleneterephthalate (PET), polycarbonate (PC), polypropylene (PP), polymethyl-methacrylate and copolymer thereof, unsaturated polyester, acrylonitrile-styrene copolymer, vinylchloride, polyurethane, epoxy resin, and cellulose-based resin such as triacetyl-cellulose and diacetyl-cellulose, among these materials, polyethyleneterephthalate (PET) or polycarbonate (PC) is preferably used. The form of the substrate may be film, sheet, or plate dependently on required specification and application. The thickness of the substrate is not limited, and may be selected dependently on required specification and application. A hard coat layer may be formed on the back side (the side on which the reflection preventing optical thin film is not formed) of the anti-reflection member dependently on application of the anti-reflection member.

Examples of application of the anti-reflection member in accordance with the first embodiment and the second embodiment of the present invention include, for example, application on the panel surface of cathode ray tubes, and the surface of picture display portions of liquid crystal displays, plasma displays, and EL displays, and for example, application as filter to be provided in front of a cathode ray tube and application on the surface of various optical lenses. For example, on the back side (the side on which the hard coat layer is not formed) of the anti-reflection member in accordance with the first embodiment and the second embodiment of the present invention, an adhesive layer or pressure sensitive adhesive layer is formed, and the anti-reflection member may be applied on the panel surface of a cathode ray tube with interposition of such adhesive layer or pressure sensitive adhesive layer. When, by applying the anti-reflection member with pressing thereon in vacuum, trapping of air between the anti-reflection member and the panel surface of the cathode ray tube is prevented. Further, ultraviolet-curing resin adhesives are also used effectively.

On the uppermost layer of the reflection preventing optical thin film, a layer consisting of fluorine-based material such as polytetrafluoroethylene, tetrafluoroethylene-perfluoro-alkylvinyl-ether copolymer, polychlorotrifluoroethylene, tetrafluoroethylene-ethylene copolymer, chlorotrifluoroethylene-ethylene copolymer, polyvinylidenefluoride, and polyvinyl-fluoride may be formed to prevent staining with fingerprints. In this case, the thickness of the layer may be 3 to 100 nm so as not to influence adversely on the reflection preventing effect.

Film thickness of the first layer and the second layer of the reflection preventing optical thin film of the anti-reflection member in accordance with the first embodiment of the present invention, or film thickness of the second layer and the third layer of the reflection preventing optical thin film of the anti-reflection member in accordance with the second embodiment of the present invention may be determined according to the film thickness determining method based on two layered structure with V-shape structure and W-shaped structure comprising what is called ($\lambda/4$–$\lambda/2$) film or the film thickness determining method based on three layered structure comprising what is called ($\lambda/4$–$\lambda/2$–$\lambda/4$) film.

In conventional art, an ITO layer is formed by spattering using a target of oxide ITO. On the other hand, in the anti-reflection member or the manufacturing method thereof in accordance with the first embodiment of the present invention, the transparent conductive oxide film which is the first layer of the reflection preventing optical thin film in contact with the hard coat layer is formed by reactive physical vapor phase deposition. When reactive spattering using a metal or alloy target is used as reactive physical vapor phase deposition, the spattering is carried out under a spattering condition of insufficient oxygen unlike conventional spattering technique in which a oxide target is used. In this case, when spattered particles are deposited on a hard coat layer, completely oxidized particles are not deposited on a hard coat layer, but partially active metal or alloy spattered particles are deposited on a hard coat layer and react with oxygen atoms in molecules which forms the hard coat layer, thus the reaction results in chemical strong adhesion. As a result, the adhesion (adhesion strength) between the transparent conductive oxide film and hard coat layer is improved. In the anti-reflection member in accordance with the first embodiment of the present invention, the combination of the transparent conductive oxide film with the second layer leads to the effective prevention of light reflection, on the other hand, transparent conductive oxide film provides antistatic function and electromagnetic radiation shielding function to the anti-reflection member.

In the case that elements which form the conductive light absorbing film have no or little affinity with oxygen in molecules which form the hard coat layer, adhesion between the conductive light absorbing film and hard coat layer is considered to be insufficient. On the other hand, in the anti-reflection member or the manufacturing method thereof in accordance with the second embodiment of the present invention, the transparent oxide film which is the first layer of the reflection preventing optical thin film in contact with the hard coat layer is formed by reaction physical vapor phase deposition. When reactive spattering using a metal or alloy target is used as reactive physical vapor phase deposition, the spattering is carried out under a spattering condition of insufficient oxygen unlike conventional spattering technique in which a oxide target is used. In this case, when spattered particles are deposited on a hard coat layer, completely oxidized particles are not deposited on a hard coat layer, but partially active metal or alloy spattered particles are deposited on a hard coat layer and react with oxygen atoms in molecules which forms the hard coat layer, thus the reaction results in chemical strong adhesion. As a result, the adhesion (adhesion strength) between the transparent oxide film and hard coat layer is improved. In the anti-reflection member in accordance with the second embodiment of the present invention, the combination of the conductive light absorbing film with the third layer leads to the effective prevention of light reflection, on the other hand, conductive light absorbing film provides antistatic function and electromagnetic radiation shielding function to the anti-reflection member. The transparent oxide film is provided with anti-reflection function by adjusting the film thickness of the transparent oxide film. The transparent oxide film is provided with antistatic function and electromagnetic radiation shielding function by using a conductive transparent oxide film.

DETAIL DESCRIPTION OF PREFERRED EXAMPLE

Figure 1:
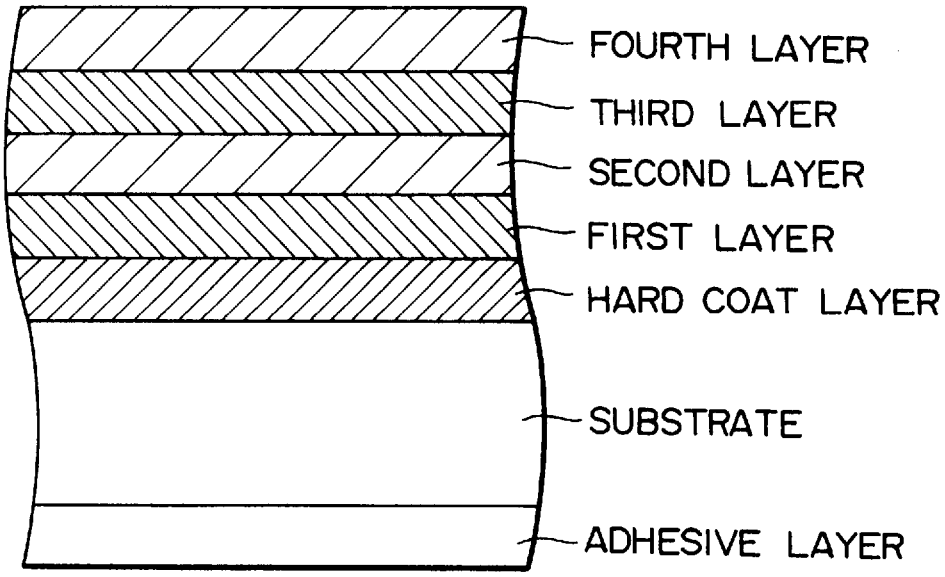
FIG. 1 is a schematic partial cross-sectional view of the anti-reflection member of Example 1.

The present invention will be described in detail hereinafter based on examples referring to the drawings.

EXAMPLE 1

Example 1 relates to the anti-reflection member and the manufacturing method thereof in accordance with the first embodiment of the present invention. In Table 3, target materials and film forming conditions for reactive spattering (in detail, DC magnetron spattering) are shown. A schematic partial cross-sectional view of the obtained anti-reflection member is shown in FIG. 1. In FIG. 1, the first layer of the reflection preventing optical thin film is a transparent conductive oxide film (thickness is 15 nm) formed by reactive DC magnetron spattering. The second layer of the reflection preventing optical thin film is a $SiO_2$ film with a thickness of 20 nm formed by conventional spattering using a target of oxide. The third layer of the reflection preventing optical thin film is a transparent conductive oxide film (thickness is 100 nm) formed by reactive DC magnetron spattering under the same conditions for forming the first layer. The fourth layer of the reflection preventing optical thin film is a $SiO_2$ film with a thickness of 85 nm formed by conventional spattering. The hard coat layer consists of PMMA. The substrate consists of PET. Film forming spattering conditions for forming the second layer and the fourth layer are shown herein under.

| | |
|---|---|
| Target | $SiO_2$ |
| Power density | 5 W/cm$^2$ |
| Atmosphere gas | Ar |
| Atmospheric pressure | 0.2 Pa |

A anti-reflection member having the same structure was prepared by conventional method. In detail, as to the conventional method shown in Table 3, the first layer of the reflection preventing optical thin film is a transparent conductive oxide film (thickness is 15 nm) formed by DC magnetron spattering using a target of oxide. The second layer of the reflection preventing optical thin film is a $SiO_2$ film with a thickness of 20 nm formed by conventional spattering using a target of oxide. The third layer of the reflection preventing optical thin layer is a transparent conductive oxide film (thickness is 100 nm) formed by DC magnetron spattering using a target of oxide. The fourth layer of the reflection preventing optical thin film is a $SiO_2$ film with a thickness of 85 nm formed by conventional spattering using a target of oxide. The substrate consists of PET. The same film forming conditions as used in Example 1 were used for forming the second layer and fourth layer. Film forming conditions for forming the third layer by spattering are shown herein under.

| | |
|---|---|
| Target | ITO |
| Power density | 5 W/cm$^2$ |
| Atmosphere gas | Ar |
| Atmospheric pressure | 0.2 Pa |

TABLE 3

| Example | Target material | Transparent conductive oxide film | Target power density ($W/cm^2$) | Atmospheric gas concentration (volume %) Ar | $O_2$ | Atmospheric pressure (Pa) | Rating of adhesion strength |
|---|---|---|---|---|---|---|---|
| 1 | In-Sn alloy | ITO | 4 | 0 | 100 | 0.2 | 4 |
| | In-Sn alloy | ITO | 4 | 30 | 70 | 0.2 | 4 |
| | In-Sn alloy | ITO | 2 | 0 | 100 | 0.2 | 4 |
| | In-Sn alloy | ITO | 2 | 30 | 70 | 0.2 | 5 |
| | Sn metal | $SnO_2$ | 4 | 0 | 100 | 0.2 | 5 |
| | Sn metal | $SnO_2$ | 4 | 30 | 70 | 0.2 | 5 |
| | Sn metal | $SnO_2$ | 2 | 0 | 100 | 0.2 | 5 |
| | Sn metal | $SnO_2$ | 2 | 30 | 70 | 0.2 | 5 |
| | Zn metal | ZnO | 4 | 0 | 100 | 0.2 | 3 |
| | Zn metal | ZnO | 4 | 30 | 70 | 0.2 | 3 |
| | Zn metal | ZnO | 2 | 0 | 100 | 0.2 | 3 |
| | Zn metal | ZnO | 2 | 30 | 70 | 0.2 | 0 |
| Conventional method | ITO oxide | ITO | 4 | 0 | 100 | 0.2 | 0 |
| | ITO oxide | ITO | 4 | 50 | 50 | 0.2 | 0 |
| | ITO oxide | ITO | 2 | 0 | 100 | 0.2 | 0 |
| | ITO oxide | ITO | 2 | 50 | 50 | 0.2 | 0 |

Sliding test was carried but for evaluation of adhesion (adhesion strength). The sliding test includes following procedures. Four pieces of cotton cloth impregnated with ethyl alcohol are wound on a steel ball with a diameter of 20 mm, 3 kgf of load is loaded on the steel ball and the loaded steel ball is brought into a contact with the uppermost layer of a reflecting preventing optical thin film placed flat, and the steel ball is reciprocated horizontally between 10 cm distance. The number of reciprocation until the steel ball causes delamination of the reflection preventing optical thin film is measured for rating of adhesion (adhesion strength).

The rating result of adhesion (adhesion strength) is shown in Table 3. The adhesion strength rating of "0" represents the delaminating within 5 cycles of reciprocation. The adhesion strength rating of "1" represents the delamination in the reciprocation cycle range from 5 to 10. The adhesion strength rating of "2" represents the delamination in the reciprocation cycle range from 10 to 20. The adhesion strength rating of "3" represents the delamination in the reciprocation cycle range from 20 to 30. The adhesion strength rating of "4" represents the delamination in the reciprocation cycle range from 30 to 40. The adhesion strength rating of "5" represents no delamination until 50 reciprocation cycles. All delamination of the reflection preventing optical thin films was caused between the first layer and hard coat layer.

From the Table 3, it is obvious that the adhesion (adhesion strength) between the first layer and hard coat layer is greatly improved for the anti-reflection member manufactured by the manufacturing method of the anti-reflection member in accordance with the first embodiment of the present invention in comparison with the anti-reflection member manufactured by the conventional method. The case in which DC magnetron spattering using Si target in oxygen gas atmosphere is applied instead of RF spattering for forming of second layer and fourth layer gives the same result.

EXAMPLE 2

Figure 2:
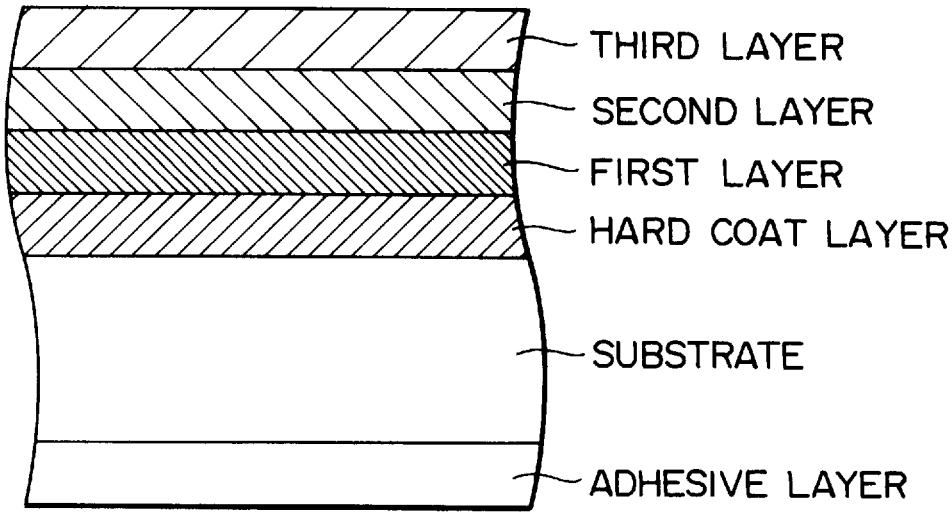
FIG. 2 is a schematic partial cross-sectional view of the anti-reflection member of Example 2.

Example 2 relates to the anti-reflection member and the manufacturing method thereof in accordance with the second embodiment of the present invention. In Table 4, target materials and film forming conditions for reactive spattering (in detail, DC magnetron spattering) are shown. A schematic partial cross-sectional view of the obtained anti-reflection member is shown in FIG. 2. In FIG. 2, the first layer of the reflection preventing optical thin film is a transparent oxide film (thickness is 4 nm) formed by reactive DC magnetron spattering. The second layer of the reflection preventing optical thin film is a TiNX (X=about 0.9) film with a thickness of 10 nm formed by reaction DC magnetron spattering in a nitrogen gas atmosphere using a target of Ti. The third layer of the reflection preventing optical thin film is a $SiO_2$ with a thickness of 100 nm formed by conventional spattering using a target of oxide. The film forming conditions for forming the third layer is the same as those used in Example 1. The hard coat layer consists of PMMA. The substrate consists of PET. Film forming spattering conditions for forming the second layer are shown herein under.

| | |
|---|---|
| Target | Ti |
| Power density | 4 $W/cm^2$ |
| Atmosphere gas | Ar + $N_2$ ($N_2$: 50 % by volume) |
| Atmospheric pressure | 0.2 Pa |

A anti-reflection member having the same structure was prepared by conventional method. In detail, as to the conventional method shown in Table 4, the first layer of the reflection preventing optical thin film is a transparent oxide film (thickness is 4 nm) formed by RF spattering using a target of oxide. The second layer and the third layer of the reflection preventing optical thin film, and hard coat layer and substrate have the same structures as those films in Example 2. The structure of the anti-reflection member when the transparent oxide film (the first layer) is not provided is the same. Film forming conditions for forming the first layer by spattering are shown herein under. Film forming conditions for forming the second layer and the third layer by spattering are the same as those in Example 2.

| | |
|---|---|
| Target | $SiO_2$, $ZrO_2$, |
| Power density | 4 $W/cm^2$ |
| Atmosphere gas | Ar + $O_2$ ($O_2$: 50 % by volume) |
| Atmospheric pressure | 0.2 Pa |

TABLE 4

| Example | Target material | Transparent conductive oxide film | Target power density ($W/cm^2$) | Atmospheric gas concentration (volume %) Ar | $O_2$ | Atmospheric pressure (Pa) | Rating of adhesion strength |
|---|---|---|---|---|---|---|---|
| 2 | Zr | $ZrO_2$ | 4 | 20 | 80 | 0.2 | 5 |
| | Ti | $TiO_2$ | 4 | 20 | 80 | 0.2 | 4 |
| | Si | $SiO_2$ | 4 | 20 | 80 | 0.2 | 4 |
| | Si | $SiO_{1.5}N_{0.3}$ | 4 | 20 | 60 | 0.2 | 4 |
| | Sn | $SnO_2$ | 4 | 20 | 80 | 0.2 | 5 |
| | Cr | $Cr_2O_3$ | 4 | 20 | 80 | 0.2 | 5 |
| Conventional method | $SiO_2$ | $SiO_2$ | 4 | 50 | 50 | 0.2 | 0 |
| | $ZrO_2$ | $ZrO_2$ | 4 | 50 | 50 | 0.2 | 0 |
| | Ti | $TiO_2$ | 4 | 50 | 50 | 0.2 | 0 |
| | $SnO_2$ | $SnO_2$ | 4 | 50 | 50 | 0.2 | 0 |
| | $Cr_2O_3$ | $Cr_2O_3$ | 4 | 50 | 50 | 0.2 | 0 |
| | ZnO | ZnO | 4 | 50 | 50 | 0.2 | 0 |
| | | | | | | | 1 |

Note: Atmosphere for film forming of $SiO_{1.5}N_{0.3}$ $Ar/O_2/N_2$ = 20/60/20 (volume %)

For evaluation of adhesion (adhesion strength), sliding test was carried out in the same manner as described in Example 1. From the result shown in Table 4, it is obvious that the adhesion (adhesion strength) between the first layer and hard coat layer is greatly improved for the anti-reflection member manufactured by the manufacturing method of the anti-reflection member in accordance with the second embodiment of the present invention in comparison with the anti-reflection member manufactured by the conventional method.

Figure 3:
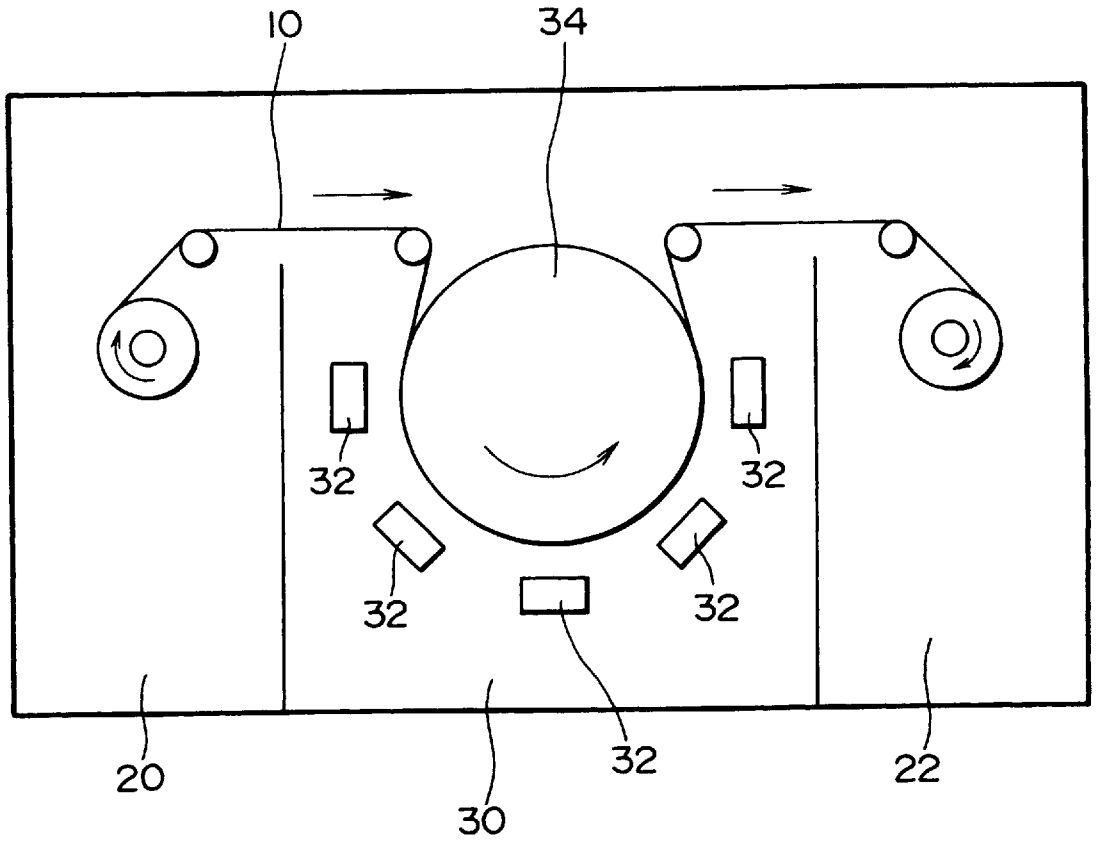
FIG. 3 is a schematic diagram of a spattering equipment suitable for continuous manufacturing of the anti-reflection member of the present invention.
Figure 4A:
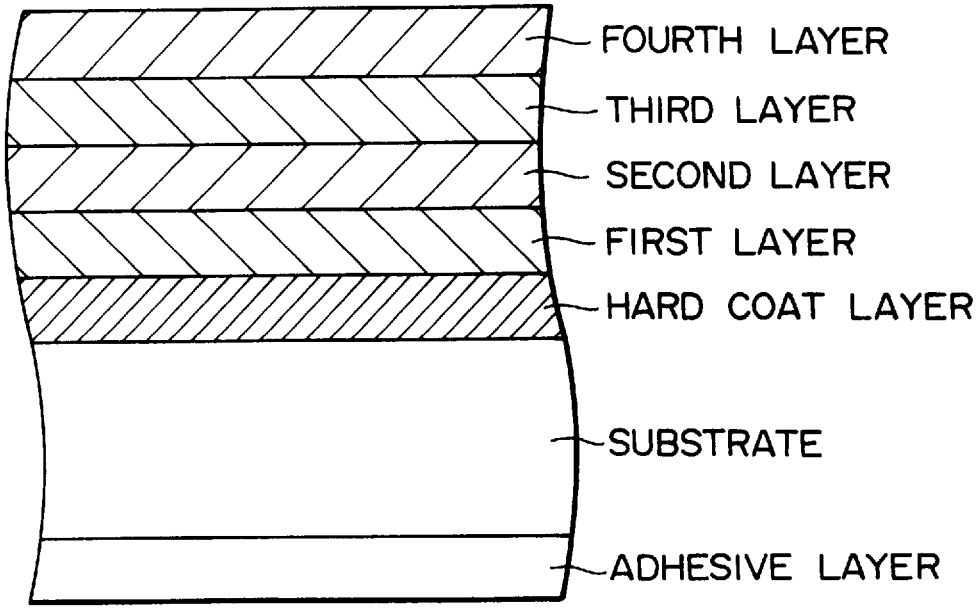
FIG. 4A PRIOR ART
FIGS. 4A and 4B are a schematic partial cross-sectional view of a conventional anti-reflection member, and a schematic partial cross-sectional view of the anti-reflection member proposed by the applicant of the present invention in Japanese Patent Application Hei 7-170925 (1995).
Figure 4B:
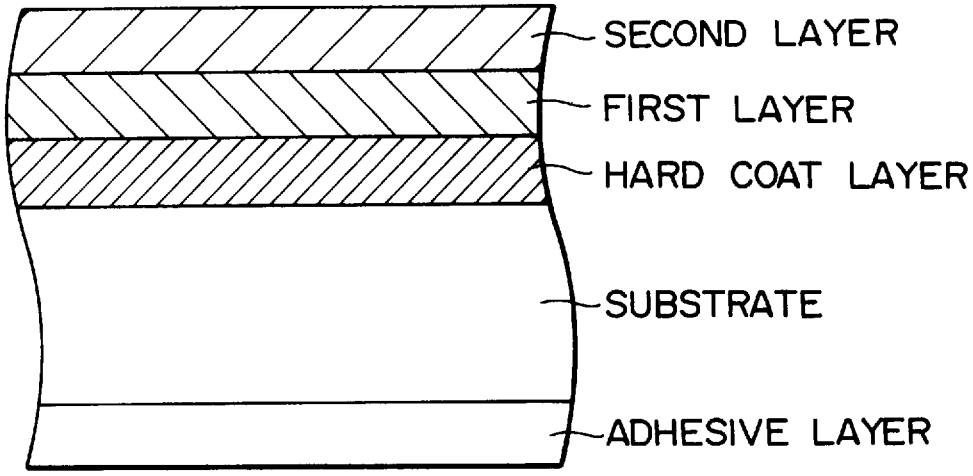
FIG. 4B PRIOR ART

For manufacturing of the anti-reflection member in accordance with the first or second embodiment of the present invention, reflection prevention optical thin films can be formed continuously using a spattering equipment shown schematically in FIG. 3. The spattering equipment comprises a roll film feeding chamber 20 for unwinding a roll film 10 on which a hard coat layer is formed previously, a spattering chamber 30 which can be brought to a reduced pressure atmosphere, and a roll film winding chamber 22 for winding the film 10. A plurality of cathodes 32 is provided in the spattering chamber 30. A target (not shown in the figure) is placed on each cathode 32, oxygen gas atmosphere is formed on each cathode surface, thus various thin films are formed successively on a hard coat layer by reactive spattering or conventional spattering.

For manufacturing the anti-reflection member in accordance with the first embodiment of the present invention using a spattering equipment having such structure, film 10 on which a hard coat layer had been formed previously is fed from the roll film feeding chamber 20, the film 10 is wound around the roller 34 in the spattering chamber 30, while, the first layer comprising transparent conductive oxide film is formed on the hard coat layer by reactive spattering using a target of metal or alloy, subsequently the second layer of the reflection preventing optical thin film is formed on the first layer by spattering, then the film 10 comprising the reflection preventing optical thin film formed on the hard coat layer is wound in the roll film winding chamber 22.

For manufacturing the anti-reflection member in accordance with the second embodiment of the present invention, film 10 on which a hard coat layer had been formed previously is fed from the roll film feeding chamber 20, the film 10 is wound around the roller 34 in the spattering chamber 30, while, the first layer comprising transparent oxide film is formed on the hard coat layer by reactive spattering using a target of metal or alloy, subsequently the second layer of the reflection preventing optical thin film comprising a conductive light absorbing film is formed on the first layer by spattering, subsequently the third layer of the reflection preventing optical thin film is formed on the second layer by spattering, and then the film 10 comprising the reflection preventing optical thin film formed on the hard coat layer is wound in the roll film winding chamber 22.

For example, Japanese Patent Laid-Open Hei 2-4967 (1990) discloses a method for forming an oxide film using a metal target. In the case of the spattering equipment disclosed in the Japanese Patent Laid-Open, a station for forming metal layer and a station for forming oxide film by oxidizing the formed metal layer are provided separately. A substrate is passed by these stations repeatedly to form desired metal oxide layers. According to the technique disclosed in this Japanese Patent Laid-Open, the spattering equipment is very complex, the productivity of metal oxide film is low.

On the other hand, the structure of the spattering equipment shown in FIG. 3 is simple, and the high productivity production of the multilayered reflection preventing optical thin film is possible, thus the production cost of the anti-reflection member can be suppressed to a low level.

On the back side (the side on which a hard coat layer is not formed) of the substrate of the anti-reflection member in accordance with the first and second embodiment of the present invention, an adhesive layer or pressure sensitive adhesive layer, for example, consisting of ultraviolet ray curing acryl-based adhesive is formed, the anti-reflection member is applied on the panel surface of a cathode ray tube with interposition of such adhesive layer or pressure sensitive adhesive layer, then the cathode ray tube applied with the anti-reflection member on its panel surface is obtained. When, by applying the anti-reflection member with pressing thereon in vacuum, trapping of air between the anti-reflection member and the panel surface of the cathode ray tube is prevented. Further, ultraviolet-curing resin adhesives are also used effectively.

The present invention has been described based on preferred examples hereinbefore. However, the present invention is by no means limited to these examples. The materials, thickness, and structure of the reflection preventing optical thin films, spattering conditions, and further, materials of the substrate and hard coat layer, and the structure of the spattering equipment for continuous film forming of the reflection preventing optical thin film are described only for example, and may be changed desirably.

According to the anti-reflection member and the manufacturing method thereof in accordance with the first embodiment of the present invention, the adhesion between the reflection preventing optical thin film and hard coat layer is greatly improved, and the anti-reflection member having high reliability for cleaning and use is provided. The transparent conductive oxide film functions as a high refractive index layer, therefore it is not necessary to form a high refractive index layer and conductive layer separately, thus the structure of the reflection preventing optical thin film is simplified, and anti-reflection members are manufactured at a low cost level. Moreover, it is not necessary to use $TiO_2$, $ZrO_2$, and $Ta_2O_5$, which have slow deposition speed in spattering, and $Y_2O_3$, which is expensive, and instead, for example, ITO, $SnO_2$, ZnO, and $I_2O_3$ can be used economically, thus the film forming cost is suppressed, and the manufacturing cost of anti-reflection members is reduced.

Also according to the anti-reflection member and the manufacturing method thereof in accordance with the second embodiment of the present invention, the adhesion between the reflection preventing optical thin film and hard coat layer is greatly improved, and the anti-reflection member having high reliability for cleaning and use is provided. Further, the structure of the reflection preventing optical thin film is simple, and thin films which constitute the reflection preventing optical thin film may be thin, therefore it is possible to manufacture anti-reflection members at a reduced cost. Moreover, for example, by using reactive DC magnetron spattering, the film forming cost is reduced, thus the manufacturing cost of anti-reflection members is reduced.

What is claimed is:

1. An anti-reflection optical element comprising;

a substrate, a hard coat layer, an anti-reflection film having first and second layers, said first layer being formed on said substrate by a PVD method and having a target material of Sn, Zn, In or an alloy consisting of In and Sn, wherein said first layer is a transparent conductive oxide layer containing a material selected from $SnO_2$, ZnO, $In_2O_3$ and ITO, and said second layer has a refractive index which is lower than that of said first layer.

2. The anti-reflection optical element as claimed in claim 1, wherein said transparent conductive Oxide layer further includes an element having a higher oxygen affinity than that of said material selected from $SnO_2$, ZnO, $In_2O_3$ and ITO.

3. The anti-reflection optical element as claimed in claim 1, wherein said second layer contains $SiO_2$ or $MgF_2$.

4. The anti-reflection optical element as claimed in claim 1, wherein said hard coat layer consists of polymethylmethacrylate.

5. The anti-reflection optical element as claimed in claim 1, wherein a conductive light absorbing layer is provided between said first layer and said second layer, and said second layer has a lower refractive index than that of said conductive light absorbing layer.

6. The anti-reflection optical element as claimed in claim 5, wherein said conductive light absorbing layer contains any one of metal, alloy, metal nitride, and metal-oxide-nitride.

7. The anti-reflection optical element as claimed in claim 6, wherein said conductive light absorbing layer contains a material selected from a group composed of Ag, Au, $TiN_X$ (X=0.3 to 1), Pt, $TiO_XN_Y$ (X=0.3 to 1, Y<1, Y≦X), $TaN_X$ (X=0.2 to 1), Pt, Al, Cu, Ta, Ni—Cr, Cu—Al, Cu—Zn—Al, Cu—Ni—Al, and Cu—Sn—Al.

8. The anti-reflection optical element as claimed in claim 1, wherein a thickness of said transparent conductive oxide layer ranges from 1 to 20 nm.

9. The anti-reflection optical element as claimed in claim 1, wherein said transparent conductive oxide layer consists of at least one material selected from a group composed of $ZrO_2$, $TiO_X$ (X=1 to 2), $SiO_XN_Y$ (X=1 to 2, Y=0.2 to 0.6), and $CrO_X$ (X=0.2 to 1.5).

10. A cathode ray tube comprising;

a glass bulb having a neck portion, a funnel portion, and a panel portion; and an outer surface of said panel is provided with an anti-reflection optical element having the structure described in claim 1.

11. A cathode ray tube as claimed in claim 10, wherein a conductive light absorbing layer is provided between said first layer and said second layer, and said second layer has a lower refractive index than that of said conductive light absorbing layer.

* * * * *